United States Patent [19]

Asao

[11] 4,442,200

[45] Apr. 10, 1984

[54] PROCESS FOR THE PREPARATION OF PHOTOGRAPHIC RESIN-COATED PAPER

[75] Inventor: Yasuzi Asao, Shizuoka, Japan

[73] Assignee: Fuji Photo Film Co., Ltd.

[21] Appl. No.: 398,824

[22] Filed: Jul. 16, 1982

[30] Foreign Application Priority Data

Jul. 24, 1981 [JP] Japan ..... 56-116170

[51] Int. Cl.[3] ..... G03C 1/76; G03C 1/86; G03C 3/00

[52] U.S. Cl. ..... 430/538; 106/300; 428/513; 430/536

[58] Field of Search ..... 427/209, 211, 391; 428/513; 430/536, 538; 106/300

[56] References Cited

U.S. PATENT DOCUMENTS

| | | | |
|---|---|---|---|
| 3,501,298 | 3/1970 | Crawford | 430/536 |
| 3,758,322 | 9/1973 | Roberts et al. | 106/300 |
| 3,825,438 | 7/1974 | Pritchard et al. | 106/308 X |
| 4,115,125 | 9/1978 | Etter et al. | 430/538 X |

*Primary Examiner*—Michael R. Lusignan

*Attorney, Agent, or Firm*—Toren, McGeady and Stanger

[57] ABSTRACT

A process for the preparation of a photographic resin-coated paper which comprises coating paper sheet with polyolefin resin of melt index in the range of 1.0–40 g./10 min. containing titanium dioxide powder coated with an alcohol having 2–18 carbon atoms and 2–4 hydroxyl groups.

9 Claims, 1 Drawing Figure

PROCESS FOR THE PREPARATION OF PHOTOGRAPHIC RESIN-COATED PAPER

Figure 1:
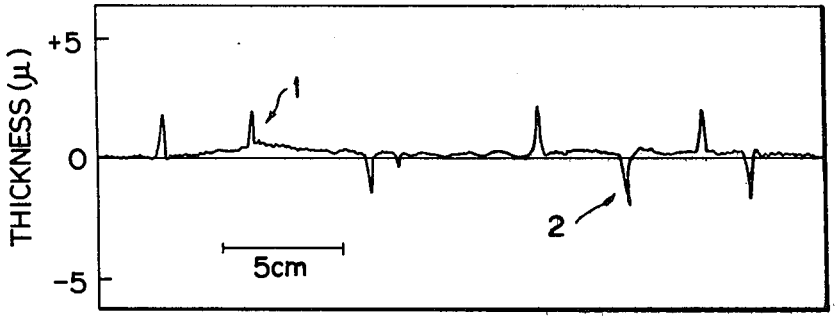

This invention relates to a process for the preparation of a photographic resin-coated paper.

There has been previously employed, as a photographic support, a baryta paper consisting of a paper sheet coated with baryta layer comprising barium sulfate on one surface. Recently, however, a water-proof photographic support consisting essentially of a paper sheet coated with hydrophobic polyolefin resin on both surfaces thereof has been developed and employed to cope with the requirement for rapid development process, replacing the conventional baryta paper.

The polyolefin resin-coated paper, as described above, generally consists of a paper sheet coated with polyolefin resin. In the polyolefin resin layer placed on one surface of the paper sheet on which a photographic emulsion layer is to be placed, there is generally contained titanium dioxide powder (pigment) for providing high whiteness and high screen.

Generally, the polyolefin resin-coated paper is prepared by coating a paper sheet with the polyolefin resin containing the titanium dioxide powder through extrusion coating. In the coating procedure, however, there sometimes is produced a scoreline on a surface of the polyolefin film extruded from the slit die, even shortly after the extrusion procedure has started. This scoreline is thought to be produced due to deposition or burning of a part of the molten resin at the die lip (die blade). Accordingly, the so produced scoreline is conventionally called "die lip scoreline". The die lip scoreline is generally produced on the extruded resin film surface in the form of a continuous line running along the longitudinal direction of the resin-coated paper. In general, the scoreline is in one of two shapes such as continuous linear projection and depression.

FIG. 1 is a graphic chart indicating roughness of a surface of an embodiment of the resin-coated paper caused by the occurrence of the die lip scoreline. The measurement of the roughness has been done by scanning continuously the surface by means of a surface roughness tester (SURFCOM manufactured by Tokyo Seimitsu Co., Ltd., Japan). In FIG. 1, the numeral 1 indicates a scoreline projected from the surface of the resin-coated paper, and the numeral 2 indicates a scoreline depressed from the surface of the resin-coated paper.

The projected scoreline 1 is thought to be produced by projection of a portion of the molten resin in the direction of thickness when a portion of the molten resin is deposited or burned outside of the exit of the die lip. In contrast, the depressed scoreline 2 is thought to be produced by local decrease of the amount of the discharged resin due to occurrence of stagnation of the molten resin when a portion of the molten resin is deposited or burned inside of the exit of the die lip.

The die lip scoreline not only extremely spoils the appearance of the photographic paper, but also causes uneven coating of a photographic emulsion on the photographic paper. The latter in turn causes occurrence of a desensitizing scoreline or a sensitizing scoreline on the photographic paper. The die lip scoreline, when occurs, does not disappear from the surface of the photographic paper, as far as the scoreline completely vanishes at the exit of the die lip. For this reason, the continuous preparation of a photographic paper sheet is necessarily interrupted when the die lip scoreline is once produced on the sheet.

The vanishment of the scoreline can be usually carried out by washing the exit of the die lip. Such washing procedure is done after disassembling the die lip from the coating apparatus. The disassembling procedure and the following washing procedure requires much labor and time, resulting in serious decrease of the productivity.

Accordingly, a principal object of the invention is to provide a process for the preparation of a photographic resin-coated paper having titanium dioxide powder in the polyolefin resin coating layer, which is free from occurrence of the die lip scoreline.

Other objects of the invention will be seen in the description given below.

The objects of the invention are accomplished by a process for the preparation of a photographic resin-coated paper which comprises coating paper sheet with polyolefin resin of melt index in the range of 1.0–40 g./10 min. containing titanium dioxide powder coated with an alcohol having 2–18 carbon atoms and 2–4 hydroxyl groups.

The reason why the combination of the titanium dioxide powder coated with the specific polyhydric alcohol and the polyolefin of the specific melt index value is effective for the suppression of occurrence of the die lip scoreline is thought as follows:

The polyolefin resin containing the titanium dioxide powder coated with the polyhydric alcohol having 2–18 carbon atoms and 2–4 hydroxyl groups is improved in the fluidity in comparison with the polyolefin resin containing the conventional untreated titanium dioxide powder. Therefore, the polyolefin composition of the invention hardly stagnates at the exit of the die lip. Moreover, the titanium dioxide powder is made inactive by the coating of the polyhydric alcohol, resulting in minimizing the burning (oxidation) of the polyolefin resin at the exit of the die lip.

The polyolefin resin having a melt index value in the range of 1.0–40 g./10 min. has a molecular weight in the adequate range for showing sufficient fluidity and also showing high resistance to burning at the exit of the die lip. Therefore, the polyolefin resin of the invention hardly deposits or burns at the exit of the die lip, resulting in decrease of the occurrence of the die lip scoreline on the extruded polyolefin composition layer. In contrast, a polyolefin resin having a melt index value less than 1.0 g./10 min. shows low fluidity due to the high molecular weight, so that it is apt to stagnate at the exit of the die lip, and a polyolefin having a melt index value more than 40 g./10 min. readily burns and decomposes under the thermal conditions at the exit of the die lip due to the low molecular weight.

Even though each of the titanium dioxide coated with the specific polyhydric alcohol and the polyolefin resin having the specific melt index value employed in the invention can serve independently for suppression of occurrence of the die lip scoreline, their combination remarkably enhances the suppression of occurrence of the die lip scoreline, as compared with a case employing one of these two factors only.

Preferred embodiments of the invention are now described hereinafter.

In the invention, there is no limitation on the titanium dioxide powder, as far as it is applicable to incorporation into a polyolefin resin layer of a photographic paper. For instance, rutile $TiO_2$ powder or anatase $TiO_2$ powder ranging in particle size of 0.1–5 microns is employed. The titanium dioxide powder may be coated with inorganic material such as silica or alumina, or may be treated with an adequate material.

Among these pre-coated or pre-tested powders, anatase-type titanium dioxide powder coated in advance with hydrated alumina in the amount less than 0.5% by weight of the powder is preferred, because it provides, after coating with the polyhydric alcohol, increased ability for suppression of occurrence of the die lip scoreline, reduces yellowing with the passage of time of the prepared photographic resin-coated paper, and improves the resolution of the photographic material.

Examples of the polyhydric alcohol having 2–18 carbon atoms and 2–4 hydroxyl groups employable in the invention include: alcohols containing 2 hydroxyl groups in the molecule such as ethylene glycol, propylene glycol, 1,3-dihydroxybutane, 1,4-dihydroxybutane, pentamethylene glycol, 2,5-dihydroxyhexane, 2,4-dihydroxy-2-methylpentane, heptamethylene glycol, and dodecamethylene glycol; alcohols containing 3 hydroxyl groups in the molecule such as trimethylolethane, trimethylolpropane, glycerol, 2,4-dihydroxy-3-hydroxylmethylpentane, 1,2,6-hexanetriol, and 2,2-bis(-hydroxymethyl)-3-butanol; and alcohols containing 3 hydroxyl groups in the molecule such as pentaerythritol.

Alcohols containing only one hydroxyl group in the molecule, and polyhydric alcohols containing 5 or more hydroxyl groups are ineffective for suppressing occurrence of the die lip scoreline.

In the invention, the polyhydric alcohol for coating the titanium dioxide powder preferably contains 2–6 carbon atoms and 2–4 methylol groups. More preferably, the polyhydric alcohol contains 4–5 carbon atoms and 3 methylol groups. Particularly, titanium dioxide powder coated with trimethylolethane is highly effective for suppression of occurrence of the die lip scoreline.

The polyhydric alcohol is preferably coated over the surface of the titanium dioxide powder in the amount of approximately 0.01–10% by weight of the titanium dioxide powder. Particularly preferred range of the coating amount is approximately 0.1–1.5% by weight of the same. The polyhydric alcohol less than 0.01% by weight is not able to suppress occurrence of the die lip scoreline. The polyhydric alcohol more than 10% by weight may be effective for suppressing occurrence of the die lip scoreline, but the polyhydric alcohol coated in such a large amount causes increased emitting of smoke and offensive odor in the melt extrusion process, resulting in deterioration of the working atmosphere.

The coating of the titanium dioxide powder with the polyhydric alcohol can be accomplished in a variety of ways. Examples of the coating procedures include: a procedure comprising immersing the titanium dioxide powder in a solvent containing the polyhydric alcohol, recovering the powder from the solution, and removing the solvent from the so recovered titanium dioxide powder through volatilization; a procedure comprising spraying a solvent containing the polyhydric alcohol over the titanium dioxide powder, and removing the solvent from the powder through volatilization; a process comprising mixing a molten polyhydric alcohol with the titanium dioxide powder; and a process comprising pulverizing solid titanium dioxide in the presence of the polyhydric alcohol. Industrially preferred processes are a process comprising pulverizing the titanium dioxide in a hydrodynamic pulverizer such as a micronizer or a jet mill under adding the polyhydric alcohol; and a process comprising mixing the titanium dioxide powder with the polyhydric alcohol in a high shearing mixer such as a Henschel mixer or a super mixer.

The titanium dioxide powder coated with the polyhydric alcohol is incorporated into a polyolefin resin generally in the amount of approximately 1–40% by weight, preferably 5–20 by weight, of the resin.

In the invention, the polyolefin resin has melt index (MI) in the range of 1–40 g./10 min., preferably 5–30 g./min. This melt index value is determined in accordance with the measurement procedure defined in JIS K 6760–1966.

Examples of the polyolefin resins of the invention include ethylene homopolymers such as high density polyethylene and low density polyethylene, propylene homopolymers, and copolymers of ethylene with one or more copolymerizable monomers. When the ethylene copolymer is selected, the copolymerizable monomer preferably amounts to not more than 10% by weight of the ethylene content. Examples of the copolymerizable monomers include alfa-olefins such as styrene, vinyl stearate, vinyl acetate, acrylic acid, methyl acrylate, ethyl acrylate, acrylamide, methacrylic acid, methyl methacrylate, ethyl methacrylate, methacrylamide; and diene compounds such as butadiene and isoprene. The polyolefin resin can be employed alone or in combination.

Incorporation of the titanium dioxide powders coated with the polyhydric alcohol into the polyolefin resin can be carried out by a conventional method such as the melt extrusion process using a kneading extruder, a heating roll mill, a Banbury mixer, or a kneader.

Preferably, the incorporation of the coated titanium dioxide powder into the polyolefin resin is carried out through preparation of a master batch. More in detail, the coated titanium dioxide powder is incorporated into the polyolefin resin in the amount of approximately 10–60% by weight, preferably 20–40% by weight, of the resin. The so prepared polyolefin resin composition containing a large amount of the coated titanium dioxide powder is diluted with a simple polyolefin resin when subjected to the melt extrusion.

The polyolefin resin composition may further contain a variety of additives such as fluorescent whitening agent, antioxidizing agent, antistatic agent, releasing agent, dye and dispersing agent, if desired.

The polyolefin resin composition containing the titanium dioxide powder coated with the polyhydric alcohol and, if desired, one or more additives, is then coated over a surface of a paper sheet through melt extrusion. In the present specification, the (melt) extrusion means a procedure comprising coating a running paper sheet with polyolefin resin composition in the form of film extruded in molten state through a slit die from an extruder. In the procedure, the polyolefin resin composition is in molten state under heating to approximately 250°–350° C., preferably 280°–320° C. The paper sheet is running at a rate of approximately 50–500 m/min., preferably 80–250 m/min. Examples of the slit dies include flat dies such as T-die, L-die and fishtail dye. The slit gap preferably ranges from approximately 0.1 to 1.5 mm.

There is no limitation on material of the paper sheet, as far as the material is able to serve as support of a photographic material. Examples of the materials of the paper sheet include natural pulp, synthetic pulp, and their mixtures. The thickness of the paper sheet generally ranges from approximately 20μ to approximately 400μ, and preferably ranges from 70μ to 250μ. The basis weight of the paper sheet generally ranges from approximately 15 g./m$^2$ to approximately 350 g./m$^2$, and preferably ranges from 50 g./m$^2$ to 200 g./m$^2$. The paper sheet may contain conventional agent such as paper strength increasing agent, sizing agent, dye, fluorescent whitening agent, a preserving agent, filler, and antistatic agent, if desired.

According to the process of the invention, occurrence of the die lip scoreline on the surface of the coated polyolefin resin composition is prominently suppressed. This means occurrence of the die lip scoreline is markedly retarded, even though it occurs, in the process for coating a paper sheet with the polyolefin resin composition. Moreover, the polyolefin resin-coated paper prepared by the invention advantageously provides a photographic material with reduced fog.

The present invention is now illustrated by the following examples, but these examples by no means restrict the invention.

EXAMPLES

A paper sheet (LBKP 100%, basis weight: 175 g./m$^2$, thickness: 180μ) was coated with polyethylene (density: 0.920 g./cc.) of different melt indexes containing titanium dioxide powder in the amount of 10% by weight of the polyethylene, through melt extrusion. The so produced polyethylene composition layer was of thickness of 30μ.

The melt extrusion was carried out by means of a melt extruder comprising a screw extruder (extrusion diameter: 60 mm) and a T die (width: 500 mm) at a film take-off rate of 100 m/min. The melt extrusion temperature was 300° C. The chill roller employed had plain surface with hard chromium plated layer.

The titanium dioxide powders employed in the examples were as follows:

(A) simple anatase-type titanium dioxide powder;

(B) anatase-type titanium dioxide powder coated with 2,4-dihydroxy-2-methylpentane in the amount of 0.5% by weight of the powder prepared by immersing the titanium dioxide powder in ethanol containing 2,4-dihydroxy-2-methylpentane, recovering it from the ethanol solution, and drying the recovered powder to remove the ethanol;

(C) anatase-type titanium dioxide powder coated with trimethylolpropane in the amount of 0.5% by weight of the powder prepared by pulverizing a mixture of trimethylolpropane and titanium dioxide in a jet mill; and (D) anatase-type titanium dioxide powder coated with trimethylolethane in the amount of 0.5% by weight of the powder prepared by pulverizing a mixture of trimethylolethane and titanium dioxide in a jet mill.

The evaluation on suppression of occurrence of the die lip scoreline was carried out by determining a period of time until occurrence of the die lip scoreline on the surface of the resin-coated paper sheet.

TABLE 1

| Sample No. | Melt Index of Polyethylene | Titanium Dioxide Powder | Period until Occurrence of Die Lip Scoreline |
|---|---|---|---|
| 1 | 0.5 g./10 min. | (A) | 30 min. |
| 2 | " | (D) | 1 hr. |
| 3 | 50 g./10 min. | (D) | 45 min. |
| 4 | 10 g./10 min. | (A) | 1 hr. |
| 5 | 2.0 g./10 min. | (D) | 4 hrs. |
| 6 | 10 g./10 min. | (B) | 4 hrs. |
| 7 | " | (C) | 6 hrs. |
| 8 | " | (D) | longer than 10 hrs. |
| 9 | 35 g./10 min. | (D) | 4 hrs. |

The results given in Table 1 show that Samples No. 5–No. 9 according to the invention were prominently improved in the suppression of occurrence of the die lip scoreline.

I claim:

1. A process for the preparation of a photographic resin-coated paper which comprises coating a paper sheet with polyolefin resin of melt index in the range of 1.0–40 g./10 min. containing titanium dioxide powder coated with an alcohol having 2–18 carbon atoms and 3 methylol groups.

2. The process as claimed in claim 1, in which the melt index of polyolefin resin is in the range of 5.0–30 g./min.

3. The process as claimed in claim 1, in which the alcohol contains 2–6 carbon atoms.

4. The process as claimed in claim 1, in which the alcohol contains 4–5 carbon atoms.

5. The process as claimed in claim 1, in which the alcohol is trimethylolethane.

6. The process as claimed in claim 1, in which the alcohol is coated over the titanium dioxide powder in the amount of about 0.01 to about 10 percent by weight of the titanium dioxide powder.

7. The process as claimed in claim 1, in which the alcohol is coated over the titanium dioxide powder in the amount of about 0.1 to about 1.5 percent by weight of the titanium dioxide powder.

8. The process as claimed in claim 1, in which the polyolefin resin is polyethylene resin.

9. A method for suppressing occurrence of die lip scoreline on polyolefin resin film extruded from die onto paper sheet in a process for the preparation of a photographic resin-coated paper comprising coating the paper sheet with the polyolefin resin containing titanium dioxide powder through extrusion coating procedure, which comprises employment of the titanium dioxide powder coated with an alcohol having 2–8 carbon atoms and 3 methylol groups and the polyolefin resin of melt index in the range of 1.0–40 g./10 min.

* * * * *